United States Patent [19]

Anderson et al.

[11] 3,941,555

[45] Mar. 2, 1976

[54] NON-SHORTING PHOTOFLASH LAMP

[75] Inventors: Robert M. Anderson, Pepper Pike; John C. Sobieski, Novelty, both of Ohio

[73] Assignee: General Electric Company, Schenectady, N.Y.

[22] Filed: May 6, 1974

[21] Appl. No.: 467,271

[52] U.S. Cl. ..... 431/93

[51] Int. Cl.[2] ..... F21K 5/02

[58] Field of Search ..... 431/93–95

[56] References Cited

UNITED STATES PATENTS

| | | | |
|---|---|---|---|
| 2,729,960 | 1/1956 | Anderson | 431/95 |
| 3,116,623 | 1/1964 | McCarty | 431/95 |
| 3,228,216 | 1/1966 | Desauliniers et al. | 431/95 |

FOREIGN PATENTS OR APPLICATIONS

| | | | |
|---|---|---|---|
| 831,391 | 3/1960 | United Kingdom | 431/95 |

*Primary Examiner*—Carroll B. Dority, Jr.
*Attorney, Agent, or Firm*—Norman C. Fulmer; Lawrence R. Kempton; Frank L. Neuhauser

[57] ABSTRACT

A glass support bead through which inlead wires extend in a miniature type of flash lamp is shaped to have sloping sides and a narrow ridge at the top extending from one to the other of the inlead wires, so that any unburned metal foil in a flashed lamp is not likely to accumulate on the top of the bead so as to cause an electrical short between the inlead wires.

7 Claims, 4 Drawing Figures

NON-SHORTING PHOTOFLASH LAMP

CROSS-REFERENCE TO RELATED APPLICATION

Ser. No. 356,459, filed May 2, 1973, John Baldrige, Jr., and John C. Sobieski, "Photoflash Lamp Having Non-Shorting Construction," issued as U.S. Pat. No. 3,816,054 on June 11, 1974, and assigned the same as this invention.

BACKGROUND OF THE INVENTION

The invention is in the field of photoflash lamps of the miniature type in which a pair of inleads carry a filament or other electrical ignition means inside a bulb having a volume less than two cubic centimeters and containing combustion material such as shredded metal foil and a combustion-supporting gas such as oxygen. Miniature flash lamps of this type are disclosed in U.S. Pat. Nos. 2,982,119 to Robert Anderson and 3,506,385 to Kurt Weber and George Cressman. The inleads extend into the bulb through a seal at the base of the bulb, and the lamps are conventionally positioned base-down when flashed in flashcubes and multiple flash arrays.

When such a photoflash lamp is flashed, the shredded metal foil burns in an oxygen atmosphere and produces an intense flash of light. Occasionally, some remnants of metal will remain in a flashed lamp and tend to bridge across the inleads, causing an electrically shorted flashed lamp. Due to the small size of miniature flash lamps, it is not feasible to provide an internal glass stem to seal and support the inleads within the bulb as had been the case with previous large-bulb flash lamps because such an internal stem would be difficult to construct in such a small bulb and would considerably reduce the amount of space available for the oxygen.

In miniature flash lamps of the type containing a glass support bead through which the inleads are sealed, unburned foil remnants can fall on top of the bead and cause a short between the inleads. In miniature flash lamps of the type not having a support bead, unburned foil remnants can fall between the inleads to the bottom of the lamp and cause a short.

Such shorting of a flashed lamp is undesirable because it will cause a short circuit on the battery or other power source until the lamp is removed from the circuit. Many lamp flashing circuits alleviate the problem by providing a quick make-and-break synchronizing switch which, after closing to apply current to the filament to cause a lamp to flash, immediately opens to provide an afterflash open circuit even though the flashed lamp may be shorted. Such switch circuits are customarily employed for flashing individual flash lamps, and the four flash lamps of a flashcube.

Firing circuits, employing transistor devices or other types of switches, have been developed for sequentially flashing, one at a time, a plurality of flash lamps in the form of a multiple-flash array. All of the lamps at the front side of the array are flashed in turn without moving or turning the array. An example of such a multiple-flash array, having five flash lamps on each side, is described in U.S. Pat. Nos. 3,598,984 to Stanley Slomski and 3,598,985 to John Harnden and William Kornrumpf. An example of an electronic firing circuit for a multiple-flash lamp array is described in U.S. Pat. No. 3,676,045 to Donald Watrous and Paul Cote. The circuit functions, basically, by sequencing past open-circuit flashed lamps, and applies a firing pulse to the first lamp in the array having a proper filament resistance (of low value such as 0.6 ohms). An "open-circuit" flashed lamp, by comparison, normally has a resistance, between its lead-in wires, of a few hundred ohms or greater. If a lamp, upon being flashed, becomes a "shorted" lamp (as described above and having a low resistance of, for example, several ohms or less), the circuit will thereafter apply each succeeding firing pulse to the shorted flashed lamp, and no further good lamps connected in the circuit can be flashed. Similar difficulty can occur with other types of sequencing circuits such as those using heat-sensitive switches. Thus, the need is evident for a flash lamp design that will almost invariably provide an open circuit upon flashing.

The above-referenced patent application is directed to a solution of the lamp-shorting problem for the type of flash lamp in which the inleads burn or melt back from the filament due to heat of combustion when the lamp is flashed. A glass sleeve is positioned around an inlead, or an electrically insulative member is positioned between the inleads, in a manner to increase the electrical path distance between the burned-back inleads when the lamp is flashed.

SUMMARY OF THE INVENTION

Objects of the invention are to provide improved photoflash lamps of the miniature type, and to provide miniature photoflash lamps which will almost invariably provide an open circuit upon flashing.

The invention comprises, briefly and in a preferred embodiment, a photoflash lamp of the miniature type having a pair of inlead wires extending into a bulb having a volume less than two cubic centimeters and containing combustible metal and a combustion-supporting gas, there being a filament or other flash ignition means connected across the inlead wires within the bulb. In accordance with the invention, a glass support bead is provided within the lamp, and the inlead wires are sealed through the support bead. The support bead is located below a substantial amount of the combustible metal in the lamp (when the lamp is in customary base-down position for flashing), and the support bead is shaped to have sloping sides and a sharp or narrow top ridge extending from one to the other of the inlead wires, to prevent any unburned metal in the flash lamp from accumulating on top of the bead and causing an electrical short between the inlead wires.

DESCRIPTION OF THE PREFERRED EMBODIMENTS

Figure 1:
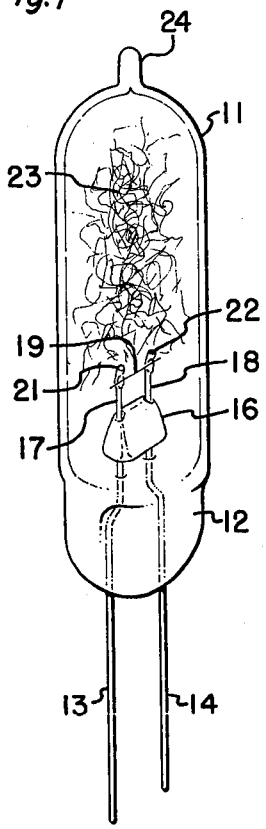
FIG. 1 is a perspective view of a photoflash lamp in accordance with a preferred embodiment of the invention.

The lamp shown in FIG. 1 of the drawing is generally the same as that shown in FIG. 5 of U.S. Pat. No. 3,506,385 to Kurt Weber and George Cressman, and comprises a tubular envelope 11, preferably made of a borosilicate glass or other suitable vitreous material having an enclosed volume of less than two cubic centimeters and having a stem press seal 12 at one end (the base end) thereof through which a pair of lead wires 13, 14 extend from the exterior to the interior of the bulb 11 in a substantially mutually parallel spaced apart manner. A bead 16 of glass or other suitable vitreous material secures the inlead portions 17 and 18 of the leads 13 and 14 in spaced relationship to each other within the bulb 11, and a filament or other flash initiation means 19 which may be coated with suitable primer ignition material is held near the ends thereof by the ends 21 and 22 of the inleads 17 and 18 at a distance above the bead 16. Alternatively, primer material may be applied over the inlead ends 21 and 22, instead of or in addition to being coated on the filament 19.

The bulb 11 is substantially filled with a loose mass of filamentary or shredded metal wire or foil 23, of zirconium or hafnium or other suitable combustible metal. Air is exhausted from the bulb 11, and the bulb is filled with oxygen at a pressure of at least several atmospheres, such as about 5 to 10 atmospheres, and the bulb is sealed off at an exhaust tip 24 at the other end thereof from the stem press seal 12. The lamp may be coated with the usual lacquer or plastic protective coating.

In accordance with the invention, the bead 16 is shaped to have sloping sides 26, 27 so as to define a sharp or narrow ridge 28 at the top of the bead and extending from one to the other of the inleads 17, 18. The bead may be made in this manner by supporting a small glass ring around the inleads 17, 18 and heating until the glass is soft, and temporarily clamping a pair of jaws across the glass to form the tapered-side bead. Then the filament 19 is mounted across the inleads, following which the leads 13, 14 are sealed through the bulb at the press seal 12.

As has been briefly mentioned, when a flash lamp is flashed, there is likely to be bits and pieces, and even kinks and curls, of unburned shredded metal foil which (assuming the lamp is flashed in base-down position) fall downwardly onto the bead 16. A lamp having lower than optimum oxygen pressure or more than the optimum amount of foil will tend to have relatively more of this unburned metal debris. Due to the sloping sides 26, 27 and narrow top ridge 28 of the bead of the invention, substantially all of the unburned metal debris falling onto the bead will slide down the slopes 26, 27 and off the bead, and, because the bead overlies the space between the inleads at the bottom of the bulb, this debris will settle on the bottom of the bulb around the inleads rather than between them. These combined effects of the tapered bead, i.e., causing metal debris to slide off the bead, and to settle on the outer periphery of the bottom of the bulb, virtually assures that the unburned metal will not short across the inleads 17, 18. Also, some metal debris can become trapped between the bead periphery and the inner wall of the bulb, where it cannot cause shorting.

Figure 2:
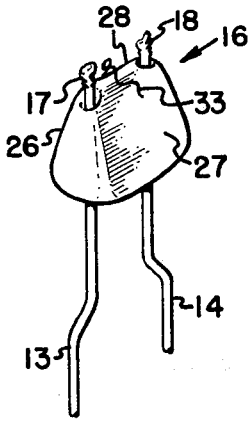
FIG. 2 is a perspective view of the filament mount of the lamp of FIG. 1 after the lamp has been flashed.
Figure 3:
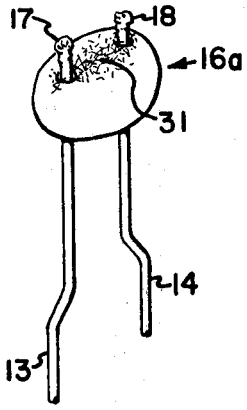
FIG. 3 shows a prior art filament mount arrangement, viewed the same as in FIG. 2, after the lamp has been flashed.
Figure 4:
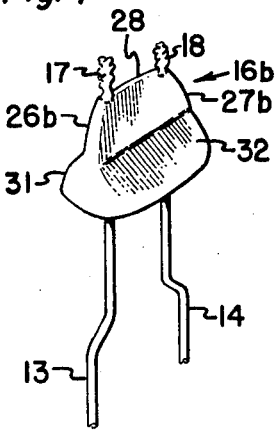
FIG. 4 is a perspective view of an alternative mount construction in accordance with the invention.

In a flash lamp having a conventional rounded bead **16*a*, as shown in FIG. 3, some unburned metal debris 31 is likely to fall and accumulate on the top of the bead with a sufficient density to cause a "short" of less than about a few ohms up to perhaps a hundred ohms across the inleads 17 and 18, the exact boundary value of resistance between a "short" and an "open circuit" depending on the characteristics of the firing circuit employed. Some of the metal particles of the debris 31 are hot enough when they contact the bead so as to stick to the bead due to their heat softening the glass at the point of contact, whereas other metal particles will be loose or will be caught on the stuck particles. FIGS. 2, 3 and 4 show the inleads 17, 18 burned back away from where the filament was, which is typical of flashed miniature flash lamps due to the high heat of combustion. The tapered bead causes any metal drippings of the burned inleads to drip down the slopes 26, 27 rather than to accumulate on top of the conventional bead 16*a***.

In the embodiment of FIG. 4, the bead **16*b* is provided with almost vertically sloped sides 26*b*, 27*b* at the upper part, and the lower part flares out at sloped shoulders 31 and 32. No undesirable result will occur if metal debris accumulates on the shoulders 31, 32,** and such is desirable in reducing the amount of metal debris that will fall down onto the bottom of the bulb.

In accordance with the invention, it is important that the narrow top ridge 28 of the bead extends directly from one to the other of the inleads 17, 18, and preferably in a straight horizontal line, so that metal debris falling on the bead will slide off without piling up against the inleads. If, for example, the bead were shaped so the narrow ridge was rotated 90° from the position shown so as to be crosswise between the inleads with the inleads extending upwardly through the sloping surfaces, then metal debris sliding down the slopes would catch and accumulate against the inleads thus increasing the possibility of an afterflash shorted lamp. Such a possibility of shorting would be increased if unburned elongated kinks or curls of unburned metal would come to rest over the top ridge of the bead.

As shown in FIG. 2, a feature of the invention is that if an elongated kink or curl 33 of unburned metal comes to rest over the top of the ridge 28, it will be oriented crosswise between the inleads 17, 18 and cannot cause a short between them.

Ideally, the narrow ridge 28 would have a sharp edge; however, a rounded edge (having radii about an axis extending from one to the other inlead) is more feasible to manufacture and will function satisfactorily, and a narrow flat-top ridge 28 is not likely to accumulate sufficient metal debris to cause a bothersome short. Preferably, the width (if flat) or diameter (if rounded) of the ridge 28 is no greater than the diameter of the inleads 17, 18, so that unburned metal debris and molten metal of the inleads will tend to slide down the slopes 26, 27 rather than accumulate on the ridge 28. The unburned metal debris will slide down the sloped bead more readily if the slopes are coated with a lubricant of high temperature type such as $MoS_2$ (molybdenum disulfide), $WS_2$ (tungsten disulfide), graphite, silicone, or Teflon.

While preferred embodiments and modifications of the invention have been shown and described, various other embodiments and modifications thereof will become apparent to persons skilled in the art and will fall within the scope of the invention as defined in the following claims. The words "top" and "bottom," etc., as used herein are to be construed in the customarily relative sense, the top and bottom of the lamp and the support bead therein remaining the same regardless of lamp orientation.

What we claim as new and desire to secure by Letters Patent of the United States is:

1. A miniature photoflash lamp comprising a bulb having an enclosed volume of less than two cubic centimeters and containing combustible metal and combustion-supporting gas, a pair of inlead conductors extending into said bulb through a base thereof, and flash ignition means connected across said inleads within said bulb, wherein the improvement comprises a support bead positioned in said bulb at a location between said base and said ignition means, said inleads extending through said support bead, said support bead having substantially flat sloping sides which slope relatively farther apart from each other toward the direction of said base and terminating at the upper edges thereof in a ridge extending from one to the other of said inlead wires, said ridge having a width no greater than the cross-section of said inleads.

2. A lamp as claimed in claim 1, in which said ridge extends in a substantially straight line from one to the other of said inleads.

3. A lamp as claimed in claim 1, in which said ridge has a rounded top surface having its radii about an axis extending from one to the other of said inleads.

4. A lamp as claimed in claim 1, in which said ridge has a substantially flat top surface.

5. A lamp as claimed in claim 1, in which said ridge is substantially sharp.

6. A lamp as claimed in claim 1, in which each of said sloping sides of the bead comprises an upper steep slope portion that is nearly vertical and a lower slope portion of less steepness than said upper slope portion.

7. A lamp as claimed in claim 1, in which said slopes of the bead are covered with a layer of lubricant material.

* * * * *